US005599175A

United States Patent [19]

Tojo et al.

[11] Patent Number: 5,599,175

[45] Date of Patent: Feb. 4, 1997

[54] MICRO FLOW CONTROLLING PUMP

[75] Inventors: Kakuji Tojo, 781-304, Kobukuro, Iizuka-shi, Fukuoka 820; Yoshiaki Hirai, Fukuoka, both of Japan

[73] Assignees: Senju Seiyaku Kabushiki Kaisha; Kakuji Tojo, both of Osaka, Japan

[21] Appl. No.: 352,379

[22] Filed: Dec. 8, 1994

[30] Foreign Application Priority Data

Dec. 9, 1993 [JP] Japan ..... 5-309134

[51] Int. Cl.[6] ..... F04B 17/00

[52] U.S. Cl. ..... 417/420

[58] Field of Search ..... 417/420; 416/3

[56] References Cited

U.S. PATENT DOCUMENTS

| | | | |
|---|---|---|---|
| 2,941,477 | 6/1960 | Dalton | 417/420 |
| 3,139,832 | 7/1964 | Saunders | 417/420 |
| 3,485,177 | 12/1969 | Clay | 103/87 |
| 3,575,536 | 4/1971 | Jacobs et al. | 417/420 |
| 4,266,914 | 5/1981 | Dickinson | 417/63 |
| 4,678,409 | 7/1987 | Kurokawa | 417/420 |
| 4,740,309 | 4/1988 | Higuchi | 210/644 |

FOREIGN PATENT DOCUMENTS

| | | | |
|---|---|---|---|
| 2141225 | 1/1973 | France . | |
| 2624217 | 6/1989 | France | 417/420 |
| 1063035 | 8/1959 | Germany . | |
| 9108432.6 | 10/1991 | Germany . | |
| 58-101282 | 6/1983 | Japan . | |
| 9320860 | 10/1993 | WIPO . | |

OTHER PUBLICATIONS

Petriconi, G. L. et al., "A simple laboratory centrifugal glass circulation pump and gas saturator for liquids," *Journal of Scientific Instruments;* vol. 42(8), Aug., 1965, p. 662.

*Primary Examiner*—Louis J. Casaregola
*Assistant Examiner*—William Wicker
*Attorney, Agent, or Firm*—Seed and Berry LLP

[57] ABSTRACT

A micro-flow controlling pump according to the present invention is used for controlling a micro-flow of a liquid in an experiment using a chemical agent for examining permeability of a membrane, reaction of a flow system, reflux of vital tissues, or the like. The micro-flow controlling pump includes: a pump body formed to have a cylindrical wall and a bottom surface, and be provided with an outflow tube formed at an outer surface of the cylindrical wall; a cover body formed to be detachably attached to the pump body and be provided with an inflow tube; a magnet rotator arranged inside the pulp body having criss-crossing blade parts; and a magnet stirrer arranged outside the pump body, having magnetic force by which the magnet rotator in the pump body can be rotated.

6 Claims, 5 Drawing Sheets

MICRO FLOW CONTROLLING PUMP

BACKGROUND OF THE INVENTION

1. Field of the Invention

The present invention relates to a micro-flow controlling pump to be used for controlling a micro-flow of a liquid in an experiment using a chemical agent for examining permeability of a membrane, reaction of a flow system, reflux of vital tissues, or the like.

2. Description of the Prior Art

Generally, an experiment for examining permeability of a flowing membrane, or the like necessitates it to control a micro-flow of a liquid.

For purpose of controlling the micro-flow, what is called an ironing pump or peristaltic pump has conventionally been utilized. According to this peristaltic pump, an elastic tube body made of silicon rubber or the like is subject to an compressing process using a roller, etc.; and a liquid is fed through this elastic tube body. Such an ironing pump has been disclosed in Japanese TOKKYO KOKAI No. 58-101282 for example.

However, such a conventional peristaltic pump has a problem that the liquid inevitably pulses through the tube body, influence of which cannot be neglected for controlling the micro-flow. To overcome the problem, it has been proposed to improve the compressing process using the roller and reduce the degree of pulsation of the liquid. However, this makes the resulting pump complicated in structure and inevitably leads to a high manufacturing cost.

Moreover, in a case of feeding a chemical liquid which is made by diluting a chemical agent to a low concentration, there arises another problem that the chemical liquid may be absorbed by the elastic tube body through the feed, and the thus absorbed chemical liquid may be dissolved again in another chemical liquid, thereby making it impossible to accurately watch behavior of the chemical agent, or the like.

SUMMARY OF THE INVENTION

The present invention, which is made considering the above problems of prior art, has an object to provide a micro-flow controlling pump for simply and accurately controlling a micro-flow of a liquid without being influenced by absorption or dissolution of the liquid.

The micro-flow controlling pump of the present invention is used for controlling a micro-flow of a liquid in an experiment using a chemical agent for examining permeability of a membrane, reaction of a flow system, reflux of vital tissues, or the like. The microflow controlling pump includes: a pump body formed to have a cylindrical wall and a bottom surface, and be provided with an outflow tube formed at an outer surface of the cylindrical wall; a cover body formed to be detachably attached to the pump body and be provided with an inflow tube; a magnet rotator arranged inside the pump body; and a magnet stirrer arranged outside the pump body, having magnetic force by which the magnet rotator in the pump body can be rotated.

In an embodiment of the present invention, the pump body and the cover body are both made of glass, and both provided with a fitting part at an opening thereof so as to connectively fit each other.

In another embodiment of the present invention, the magnet rotator includes a disk-like base, and a blade part formed on either side of the base so as to have a cross-shape in a plan view and have a protruding portion at a crossing portion thereof.

In still another embodiment of the present invention, the magnet rotator includes a disk-like base, and a blade part formed on either side of the base so as to have a plurality of arc-shaped portions.

In still further another embodiment of the present invention, the magnet rotator is covered with heat resisting and chemical resisting synthetic resin.

According to the present invention, the magnet rotator arranged inside the pump body can be rotated at arbitrary speed by means of the magnetic force of the magnet stirrer arranged outside the pump body. Therefore, flow pressure of the liquid in the pump body, which is generated by the rotation of the magnet rotator, can be controlled. With the thus controlled flow pressure, the liquid can controllably be discharged from the outflow tube.

The above and further objects, features and advantages of the invention will more fully appear from the following description with reference to the accompanying drawings. It is to be expressly understood, however, that the drawings are for purpose of illustration only and are not intended as a definition of the limits of the invention.

DETAILED DESCRIPTION OF THE PREFERRED EMBODIMENTS

Hereinafter, the present invention will be described in detail by way of illustrating examples with reference to FIGS. 1 to 7.

Figure 1:
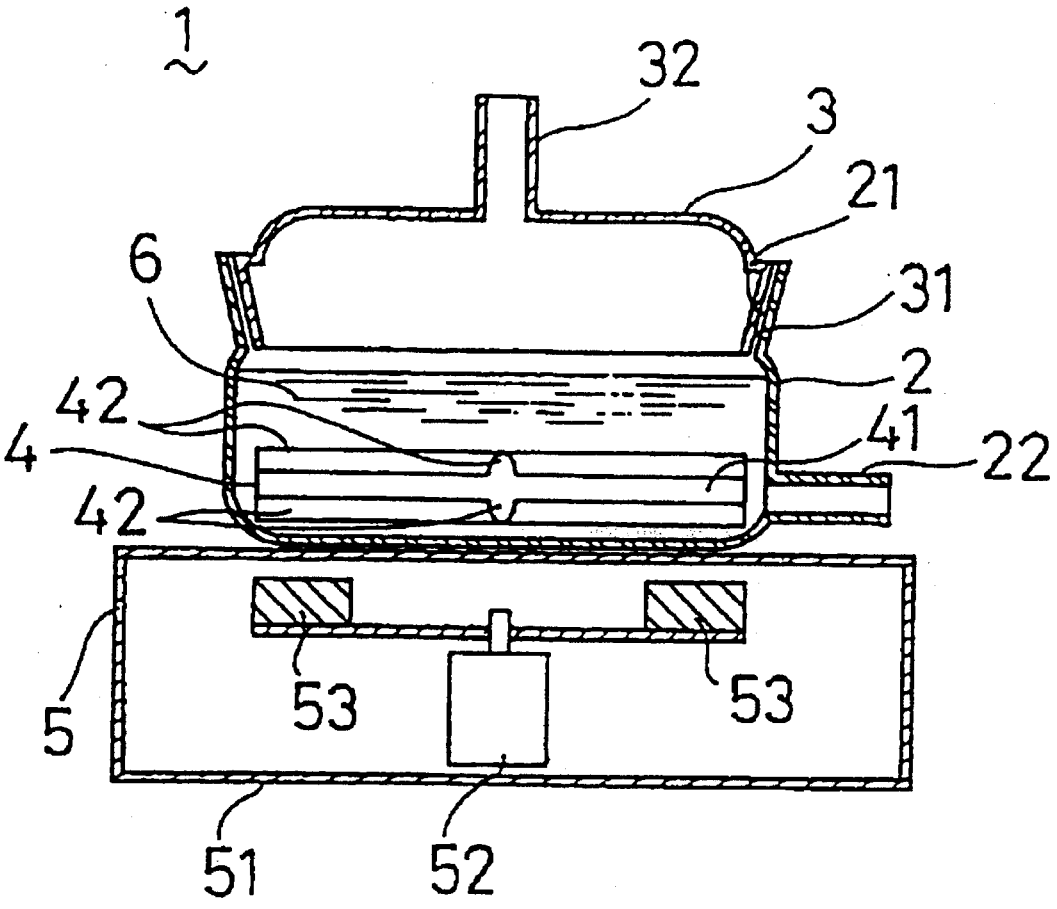
FIG. 1 is a cross-sectional view exemplarily illustrating a general structure of a micro-flow controlling pump according to the present invention.

FIG. 1 shows a general structure of a micro-flow controlling pump 1 according to an example of the present invention.

As is shown in FIG. 1, this micro-flow controlling pump 1 includes a pump body 2, a cover body 3, a magnet rotator 4, and a magnet stirrer 5.

The pump body 2 for storing a liquid 6 is made of glass so as to have a cylindrical wall and a bottom surface. At an opening of the pump body 2, a fitting part 21 is formed so as to fit the cover body 3. At an outer surface of the cylindrical wall of the pump body 2, an outflow tube 22 for discharging the liquid 6 from the pump body 2 is formed to be integrated with the pump body 2.

The cover body 3 is also made of glass, and is provided with a fitting part 31 at an outer peripheral surface thereof so as to connectively fit the fitting part 21 of the pump body 2. In addition, an inflow tube 32 is integrally formed at the cover body 3.

Figure 2A:
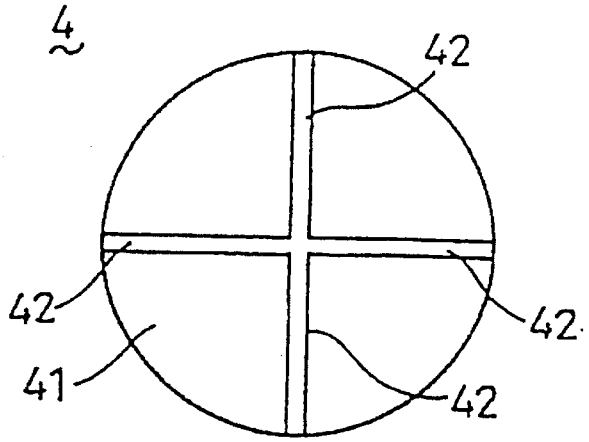
FIG. 2A is a plan view showing a magnet rotator according to an example of the present invention.
Figure 2B:
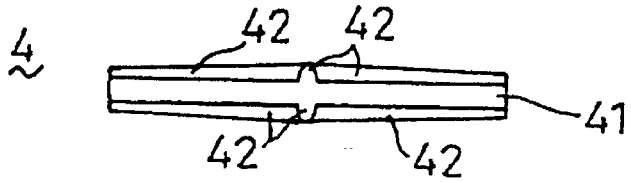
FIG. 2B is a side view showing the magnet rotator of FIG. 2A.
Figure 3A:
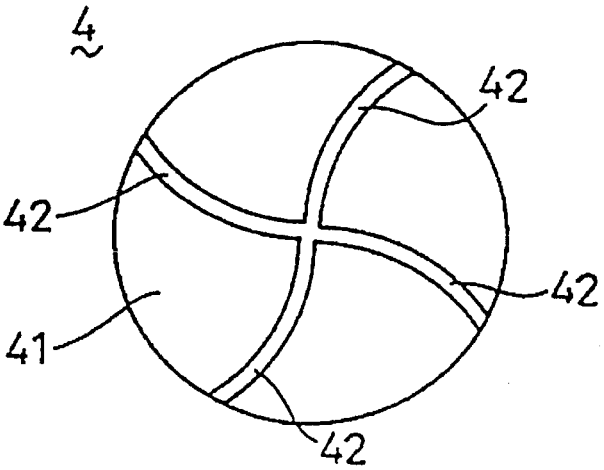
FIG. 3A is a plan view showing a magnet rotator according to another example of the present invention.
Figure 3B:
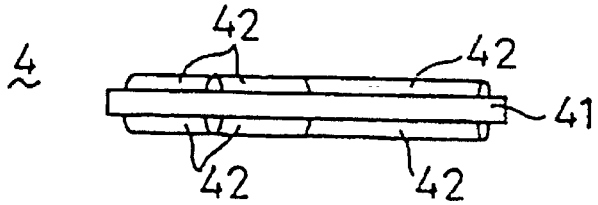
FIG. 3B is a side view showing the magnet rotator FIG. 3A.

As shown in FIGS. 2A and 2B, the magnet rotator 4 includes a base 41 and blade parts 12. The blade part 42 is formed on either side of the base 41 so as to have a cross-shape in a plan view. By means of rotating the blade parts 42 in the pump body 2, the liquid 6 can be swirlingly circulated quickly. The magnet rotator 4 has a slightly protruding portion at a crossing portion of the blade part 42 formed on either side thereof. During the rotation, the protruding portion becomes a center of the rotation, and therefore the magnet rotator 4 can be rotated stably. This magnet rotator 4 has a structure in which a metal material or a magnet is covered with heat resisting and chemical resisting plastic resin such as TEFLON (RTFE). It is needless to say that the shape of the magnet rotator 4 is not limited to that shown in FIGS. 2A and 2B, but it may have any shape as long as the liquid 6 in the pump body 2 can be swirlingly circulated by means of the rotation of the magnet rotator 4. For example, the blade part 42 may have a plurality of arc-shaped portions as shown in FIGS. 3A and 3B. Alternatively, a bar-like magnet rotator to be used in a general stirring apparatus (not shown) may be employed as the magnet rotator 4 of the present invention.

As the magnet stirrer 5 of the present invention, a magnet stirrer to be used in a general stirring apparatus may be employed. As shown in FIG. 1, the magnet stirrer 5 includes a stirrer body 51, a motor 52, and magnets 53 to be rotated by the motor 52. The speed of revolution of each magnet 53 can be controlled by adjusting a controller (not shown). With the thus controlled magnets 53, the magnet rotator 4 in the pump body 2 located on a top surface of the magnet stirrer 5 can be rotated at desired speed of revolution.

Figure 4:
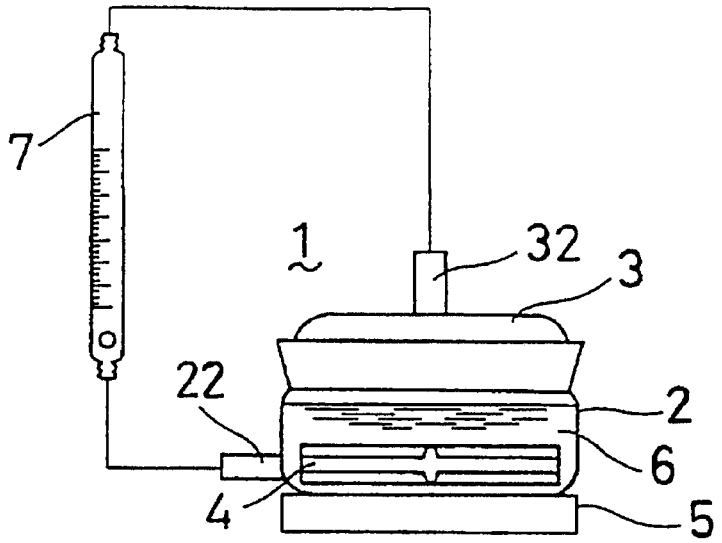
FIG. 4 is a schematic view for exemplarily illustrating a method for measuring volume of flow of a liquid discharged from a micro-flow controlling pump of the present invention.

The thus obtained micro-flow controlling pump 1 is required to determine a relationship between the number of revolution of the magnet rotator 4 and the volume of flow of the liquid 6 discharged from the pump body 2 in a prescribed period of time prior to use. To determine the relationship, a flow meter 7 is arranged between the outflow tube 22 and the inflow tube 32 of the micro-flow controlling pump 1 so as to circulate the liquid 6, as shown in FIG. 4. Next, the magnet rotator 4 is rotated at various numbers of revolution per minute by controlling the magnet stirrer 5, while graduations on the flow meter 7 are read for each number of revolution. Finally, using an analytical curve attached to the flow meter 7, volume of flow of the liquid 6 for each number of revolution can be obtained. Generally, a flow mater is provided with analytical curves with respect to various gases and liquids. For a case where an analytical curve is not provided for the liquid 6 to be measured, a method for obtaining the analytical curve will be described below. First, some volume of the liquid 6 is put into the flow meter 7 and graduations on the flow meter 7 are read at that time. Then, the volume of the liquid 6 is measured using a measuring cylinder or the like. This procedure is repeated with several different graduations on the flow meter 7, thereby obtaining the analytical curve for the liquid 6.

Figure 5:
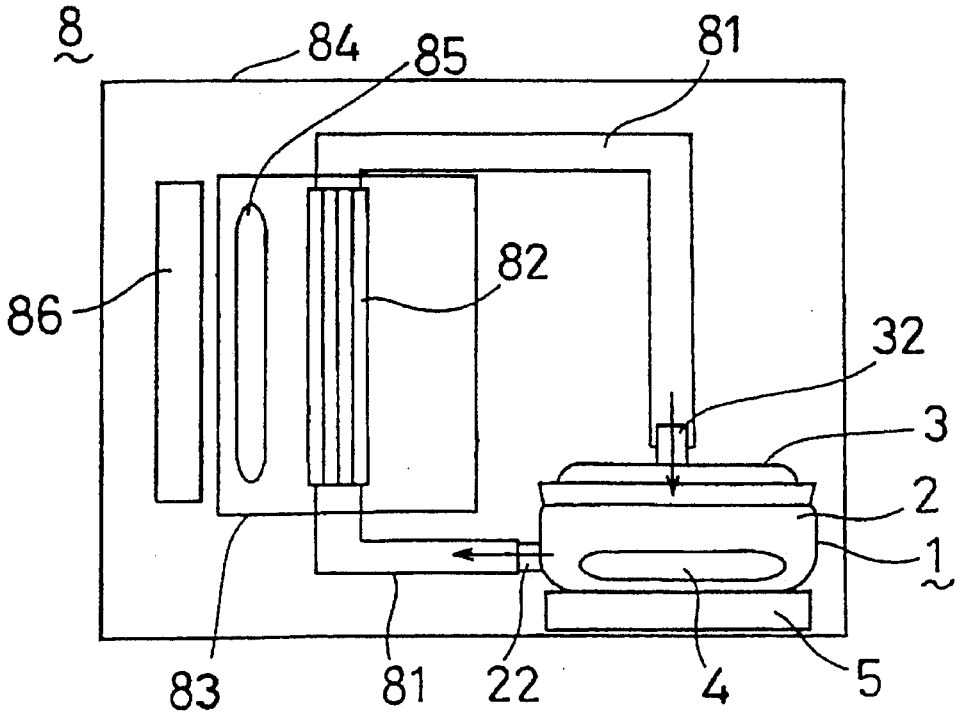
FIG. 5 is a schematic view exemplarily illustrating an experimental unit incorporating a micro-flow controlling pump of the present invention.

After the relationship between the number of revolution of the magnet rotator 4 and the volume of flow of the liquid 6 is thus obtained, the micro-flow controlling pump 1 can be effectively utilized, for example, as a circulating pump incorporated in an experimental unit 8 for examining permeability of a chemical agent against a hollow and cylindrical membrane, as shown in FIG. 5. In the experimental unit 8, the hollow and cylindrical membrane 82 is connected to the outflow tube 22 and to the inflow tube 32 of the micro-flow controlling pump 1 via tubes 81 made of a heat resisting and chemical resisting material such as TEFLON (PTFE). Then, the hollow and cylindrical membrane 82 is immersed in a donor liquid tank 83. Next, the donor liquid tank 83, tubes 81, the micro-flow controlling pump 1 are all arranged in a constant temperature tank 84. In FIG. 5, a reference numeral 85 denotes a stirring element to stir in the donor liquid tank 83, and a reference numeral 86 denotes a stirrer to stir the stirring element 85.

In a case where the micro-flow controlling pump 1 is incorporated in such an experimental unit 8, the relationship between the number of revolution of the magnet rotator 4 and the volume of flow of the liquid 6 is likely to unstable due to resistance generated when the liquid 6 is fed through the tubes 81 and the hollow and cylindrical membrane 82. Therefore, it is preferable to incorporate the flow meter 7 into the experimental unit 8 (if such incorporation will not raise any trouble in the experimental unit 8) and control the volume of flow of the liquid 6 using the flow meter 7.

PRACTICAL EXAMPLE

Figures 6A, 6B, 6C, 6D:
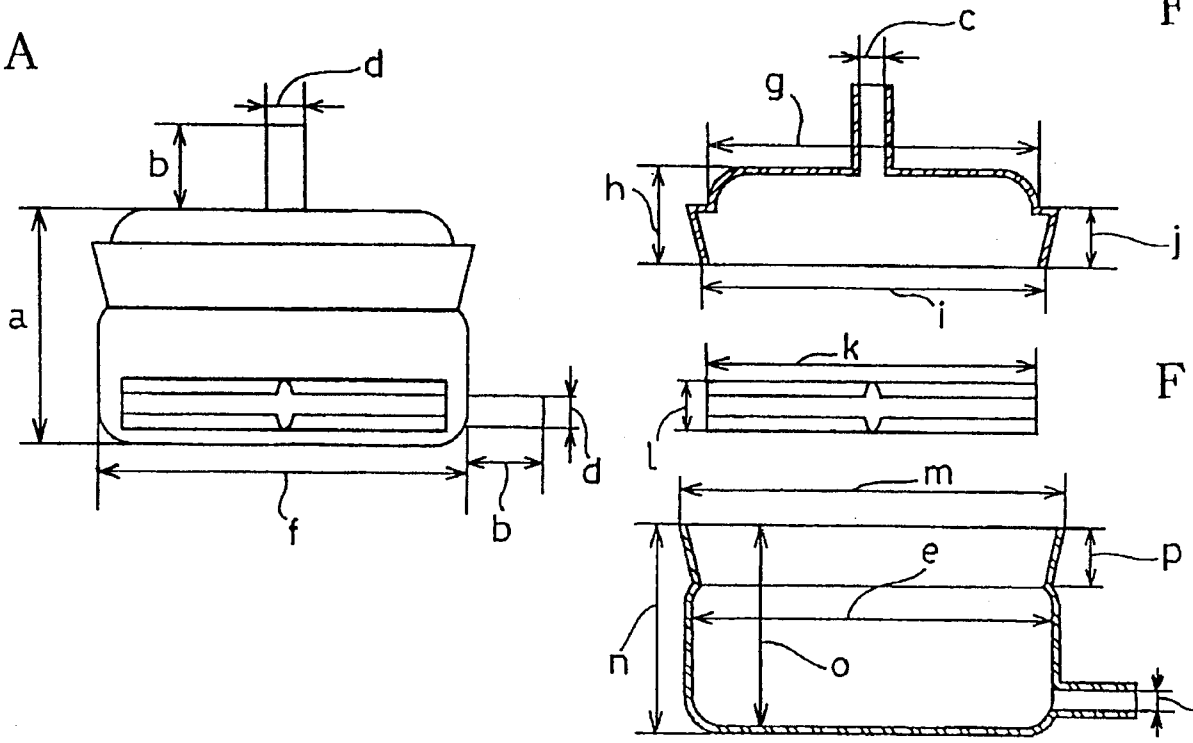
FIGS. 6A to 6D are schematic views for showing each dimension of a micro-flow controlling pump used in a practical example of the present invention.

A practical example was carried but using a microflow controlling pump 1 of the present invention. In FIG. 6, reference letters of a to p indicate respective dimensions of the micro-flow controlling pump 1. In this example, the micro-flow controlling pump 1 had dimensions a to p as follows:

| | | | |
|---|---|---|---|
| a: 36.00 mm | b: 20.00 mm | o: 4.20 mm | d: 7.00 mm |
| e: 40.00 mm | f: 45.00 mm | g: 37.00 mm | h: 17.00 mm |
| i: 35.00 mm | j: 11.00 mm | k: 34.50 mm | l: 12.00 mm |
| m: 40.00 mm | n: 30.00 mm | o: 27.50 mm | p: 11.00 mm |

This micro-flow controlling pump 1 includes a pump body 2 having content volume of 38 ml, and the magnet rotator 4 having volume of 5.7 ml. A flow meter 7 was arranged between an outflow tube 22 and an inflow tube 32, and water stored in the pump body 2 was circulated. Under this condition, the magnet rotator 4 was rotated at various numbers of revolution per minute and graduations on the flow meter 7 were read for each number of revolution. Finally, volume of flow of water was determined for each number of revolution of the magnet rotator 4, using an analytical curve attached to the flow meter 7. The result of the present example is shown in a graph of FIG. 7.

Figure 7:
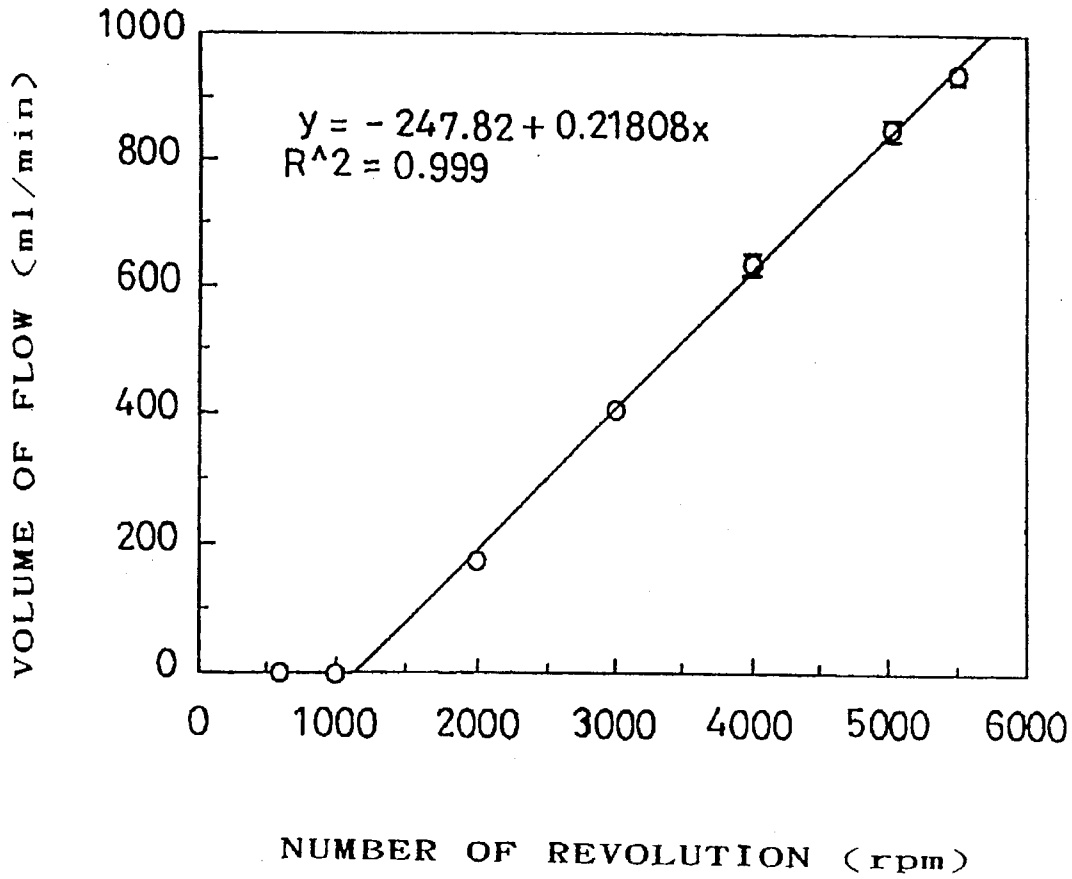
FIG. 7 is a graph showing a relationship between number of revolution per minute (rpm) of a magnet rotator of the micro-flow controlling pump and volume of flow per minute (ml/min.) of a liquid discharged from the microflow controlling pump in the practical example.

As is apparent from the graph of FIG. 7, it is confirmed that this micro-flow controlling pump 1 can accurately control even micro-flow of 1000 ml or less per minute.

As is described above, according to the present invention, the magnet rotator arranged inside the pump body can be rotated at arbitrary speed of revolution so as to circulate the liquid stored in the pump body by controlling the magnetic force of the magnet stirrer arranged outside the pump body. The pump body and the cover body can be made of heat resisting and chemical resisting glass, and the magnet rotator can be covered with heat resisting and chemical resisting resin such as Teflon, thereby preventing the liquid from being absorbed by the micro-flow controlling pump. Thus, the micro-flow of the liquid can be simply and accurately controlled without being influenced by absorption or dissolution of the liquid.

In addition, the magnet rotator can be rotated at arbitrary speed of revolution by controlling the magnet stirrer in order to control the flow pressure of the liquid in the pump body. Thus, the micro-flow of the liquid discharged from the outflow tube can delicately and accurately be controlled by controlling the flow pressure of the liquid.

Various other modifications will be apparent to and can be readily made by those skilled in the art without departing from the scope and spirit of the present invention. The scope of the present invention is therefore to be limited only by the claims appended hereto.

What is claimed is:

1. A micro-flow controlling pump for controlling a micro-flow of a liquid in an experiment using a chemical agent comprising:

a pump body having a cylindrical wall and a bottom surface, and having an outflow opening in an outer surface of the cylindrical wall;

a cover body detachably attached to the pump body and having an inflow opening therein;

a magnet rotator arranged inside the pump body, the magnet rotator having a disk-shaped base and opposing upper and lower blades extending in opposite directions away from the disk shaped base, the lower blades having criss-crossing blade parts that intersect to define a protruding crossing portion about which the magnet rotator is rotatable relative to the pump body for stable rotation during the experiment; and a magnet stirrer arranged outside the pump body having magnetic force by which the magnet rotator in the pump body is rotated.

2. A micro-flow controlling pump according to claim 1, wherein the pump body and the cover body are both made of glass, and both provided with a fitting part at an opening thereof so as to connectively fit each other.

3. A micro-flow controlling pump according to claim 1, wherein the blade parts include straight first and second blade parts that criss-cross at right angles so as to form a cross-shaped lower blade configuration.

4. A micro-flow controlling pump according to claim 1, wherein the blade parts include a plurality of arc-shaped portions that criss-cross at the protruding crossing portion.

5. A micro-flow controlling pump according to claim 3, wherein the magnet rotator is covered with heat resisting and chemical resisting synthetic resin.

6. A micro-flow controlling pump according to claim 4, wherein the magnet rotator is covered with heat resisting and chemical resisting synthetic resin.

* * * * *